US006979201B1

(12) United States Patent
Lee et al.

(10) Patent No.: US 6,979,201 B1
(45) Date of Patent: Dec. 27, 2005

(54) THREE-IN-ONE SOCKET OF AN ELECTRONIC CARD CONNECTOR

(75) Inventors: Ipson Lee, Taoyuan (TW); Joey Chang, Chung-Lee (TW)

(73) Assignee: Super Link Electronics Co., Ltd., Taoyuan (TW)

( * ) Notice: Subject to any disclaimer, the term of this patent is extended or adjusted under 35 U.S.C. 154(b) by 0 days.

(21) Appl. No.: 11/091,512

(22) Filed: Mar. 29, 2005

(51) Int. Cl.[7] ..... H01R 12/00
(52) U.S. Cl. ..... 439/64; 439/540.1
(58) Field of Search ..... 439/64, 78, 79, 439/80, 83, 540.1, 541.5, 630, 631, 682

(56) References Cited

U.S. PATENT DOCUMENTS 6,254,405 B1 * 7/2001 Hung ..... 439/101
RE38,089 E * 4/2003 Kajiura ..... 439/64
6,561,816 B1 * 5/2003 Hanyu ..... 439/64
6,773,308 B2 * 8/2004 Lwee ..... 439/630
6,821,141 B1 * 11/2004 Liu ..... 439/377
6,890,200 B1 * 5/2005 Wu ..... 439/247
6,918,177 B2 * 7/2005 Haager et al. ..... 29/832

* cited by examiner

*Primary Examiner*—Khiem Nguyen
(74) *Attorney, Agent, or Firm*—Rosenberg, Klein & Lee

(57) ABSTRACT

A three-in-one socket of an electronic card connector includes a plastic main body which is formed with a first, a second and a third types of terminal mounting orifice sections. The first type of terminal mounting orifice section is formed with two rows of terminal mounting orifices in each of which a first type of terminal is inlaid for correspondingly connecting with a terminal of a first type of electronic card connector. The second and third types of terminal mounting orifice section are formed with a row of terminal mounting orifices in each of which a second and third types of terminal are inlaid for correspondingly connecting with a terminal of a second type of electronic card connector, respectively.

5 Claims, 18 Drawing Sheets

THREE-IN-ONE SOCKET OF AN ELECTRONIC CARD CONNECTOR

BACKGROUND OF THE INVENTION

1. Field of the Invention

The present invention is related to a three-in-one socket of an electronic card connector adaptable to three different types of electronic card connectors.

2. Description of the Prior Art

A notebook computer or other electronic apparatus is equipped with a card reader. The card reader has an electronic card connector for accessing data of an electronic card such as PCMCIA (Personal Computer Memory Card International Association) card, smart card and express card. The electronic card connector has a plastic main body formed with a slide slot in which a corresponding electronic card can be slid. Multiple terminals are inlaid in bottom end of the slide slot. One end of each terminal extends out of the plastic main body to be soldered on a circuit board. When an electronic card is inserted into the connector to electrically connect with the terminals, a user can read the data of the electronic card via the card reader or store data into the electronic card.

In manufacturing of the card reader, the terminals of the electronic card connector are directly soldered on the circuit board. In order to meet the requirements of three different kinds of electronic cards, the manufacturers must manufacture different circuit boards on which three different types of electronic card connectors are soldered. This leads to trouble in manufacturing and management.

SUMMARY OF THE INVENTION

It is therefore a primary object of the present invention to provide a three-in-one socket of an electronic card connector. The socket includes a plastic main body formed with a first, a second and a third types of terminal mounting orifice sections. The first type of terminal mounting orifice section is formed with two rows of terminal mounting orifices in each of which a first type of terminal is inlaid for correspondingly connecting with a terminal of a first type of electronic card connector (such as PCMCIA card connector). The second type of terminal mounting orifice section is formed with a row of terminal mounting orifices in each of which a second type of terminal is inlaid for correspondingly connecting with a terminal of a second type of electronic card connector (such as smart card connector). The third type of terminal mounting orifice section is formed with a row of terminal mounting orifices in each of which a third type of terminal is inlaid for correspondingly connecting with a terminal of a third type of electronic card connector (such as express card connector). After the socket is installed on a circuit board, the circuit board is adaptable to three different types of electronic card connectors.

The present invention can be best understood through the following description and accompanying drawings wherein:

DETAILED DESCRIPTION OF THE PREFERRED EMBODIMENTS

Figure 1:
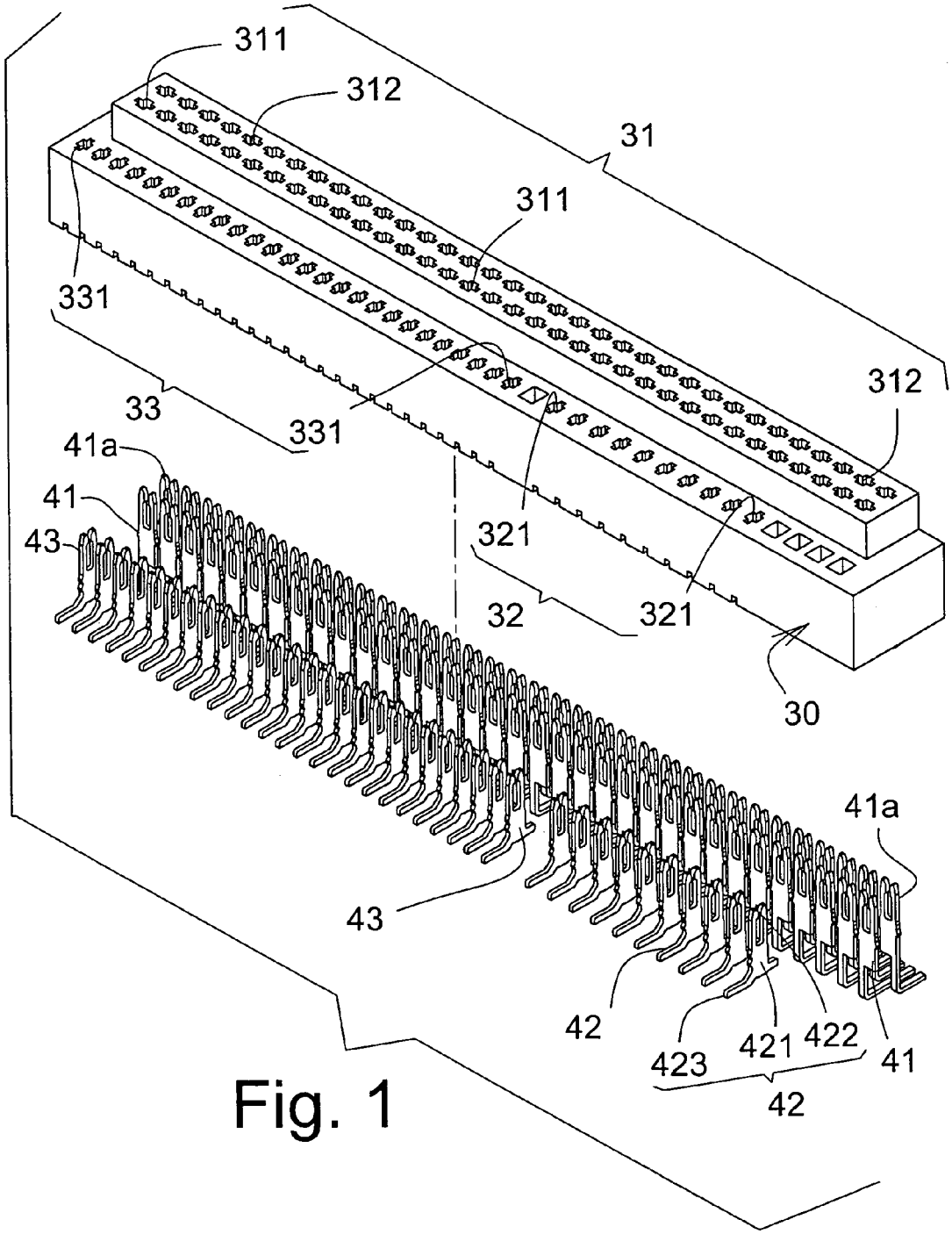
FIG. 1 is a perspective exploded view of the present invention.
Figure 2:
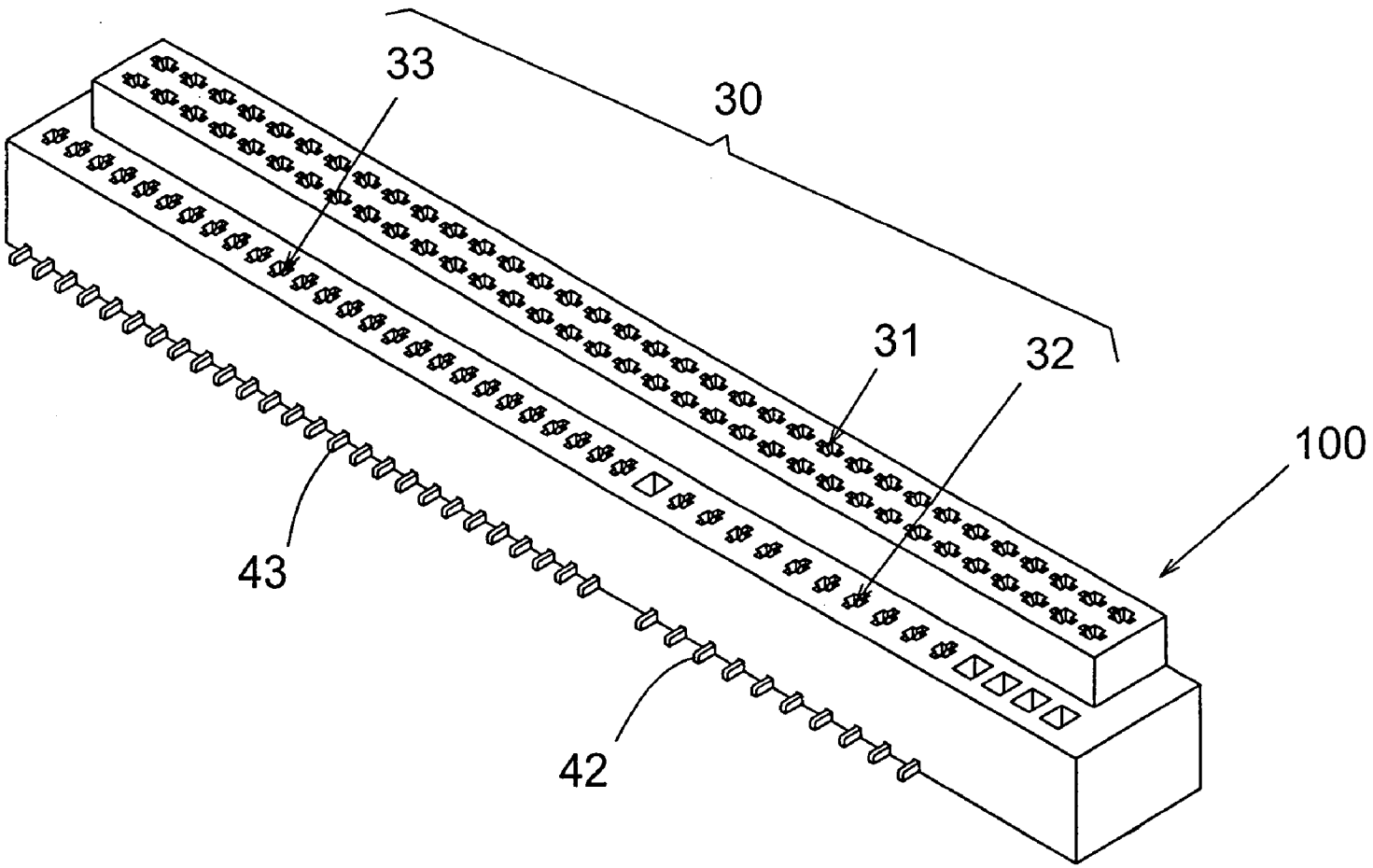
FIG. 2 is a perspective assembled view of the present invention.
Figure 3:
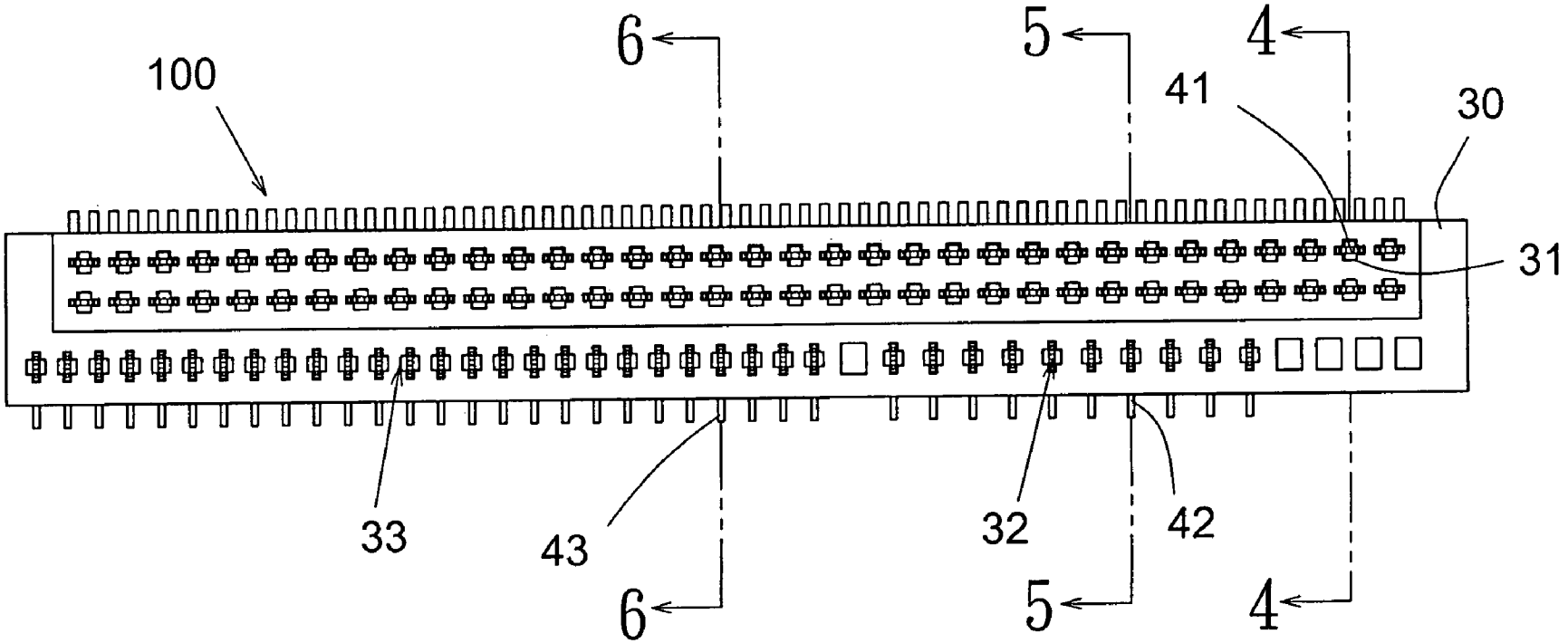
FIG. 3 is a top view according to FIG. 2.

Please refer to FIGS. 1 to 10. The three-in-one socket 100 of the electronic card connector of the present invention has a plastic main body 30. The plastic main body 30 is formed with a first type of terminal mounting orifice section 31, a second type of terminal mounting orifice section 32 and a third type of terminal mounting orifice section 33. The first type of terminal mounting orifice section 31 is formed with two rows of terminal mounting orifices 311, 312 in which a first type of terminals 41, 41*a* are inlaid for correspondingly connecting with the terminals 53, 54 of a first type of electronic card connector 50. The second type of terminal mounting orifice section 32 is formed with a row of terminal mounting orifices 321 in which a second type of terminals 42 are inlaid for correspondingly connecting with the terminals 65 of a second type of electronic card connector 60. The third type of terminal mounting orifice section 33 is formed with a row of terminal mounting orifices 331 in which a third type of terminals 43 are inlaid for correspondingly connecting with the terminals 73 of a third type of electronic card connector 70. Accordingly, after the socket of the present invention installed on a circuit board 80, the circuit board 80 is adaptable to three different types of electronic card connectors. Therefore, the commonness of the circuit board is widened.

The three-in-one socket 100 of the electronic card connector of the present invention is applicable to those electronic apparatuses with card-reading function, such as notebook computer, identification unit, etc. The application range of the present invention is not limited.

Figure 7:
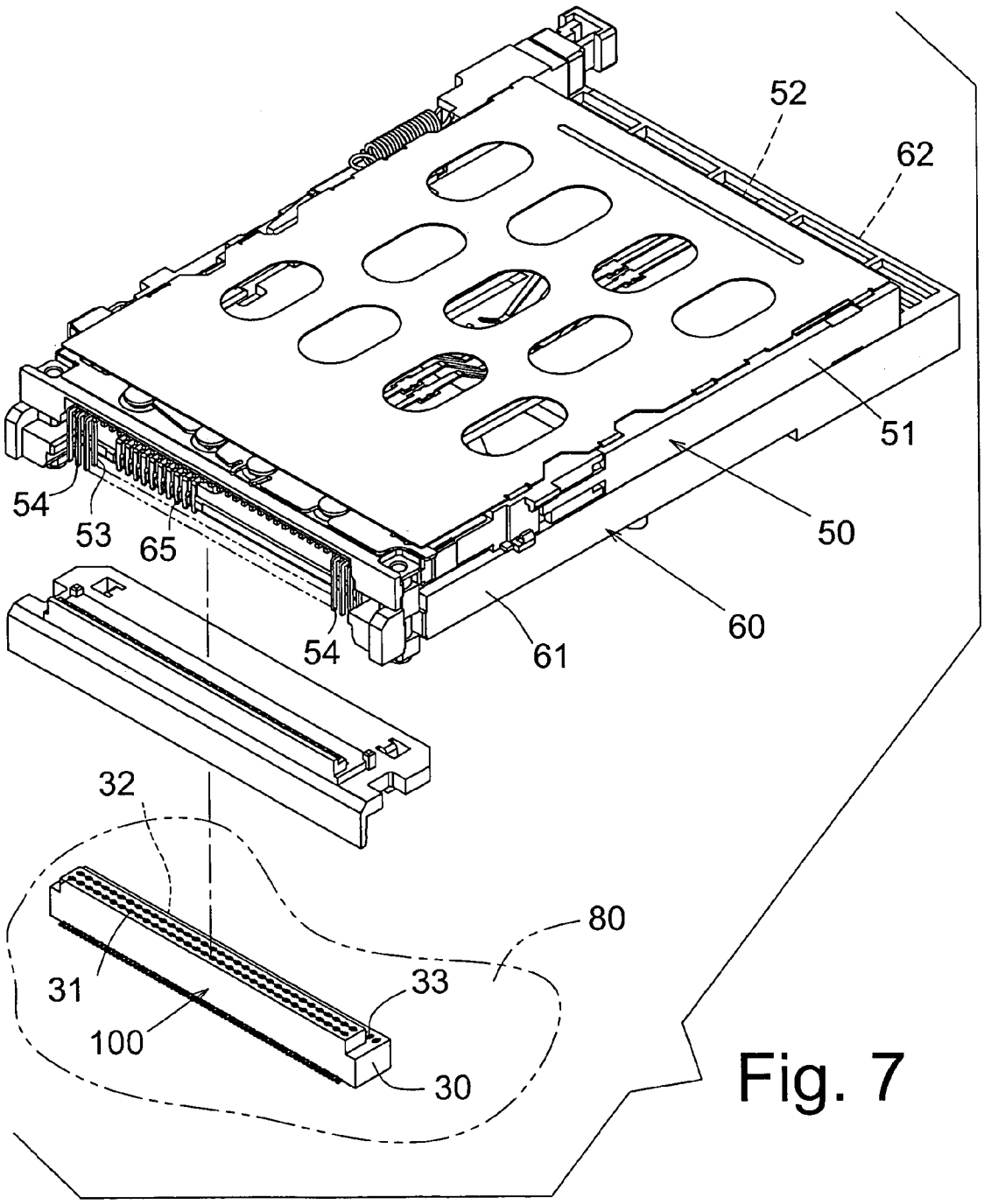
FIG. 7 is a perspective view showing that a stacked electronic card connector composed of the first and second types of electronic card connector is inserted in the present invention.

Referring to FIG. 7, the first type of electronic card connector 50 is a PCMCIA electronic card connector. The electronic card connector 50 includes an insulating main body 51 formed with a slide slot 52 in which a PCMCIA card can be inserted. Multiple terminals 53, 54 are inlaid in rear end of the slide slot 52. The terminals 53, 54 protrude from the insulating main body 51 to be correspondingly inserted into the terminal mounting orifices 311, 312 of the first type of terminal mounting orifice section 31 of the socket 100. The terminals 53, 54 are electrically connected with the first type of terminals 41, 41*a* in the terminal mounting orifices 311, 312. The first type of electronic card connector 50 in not the subject of the present invention. The three-in-one socket 100 of the electronic card connector of the present invention is applicable to all the conventional electronic card connectors. The application range of the present invention is not limited to the first type of electronic card connector 50.

Figure 4:
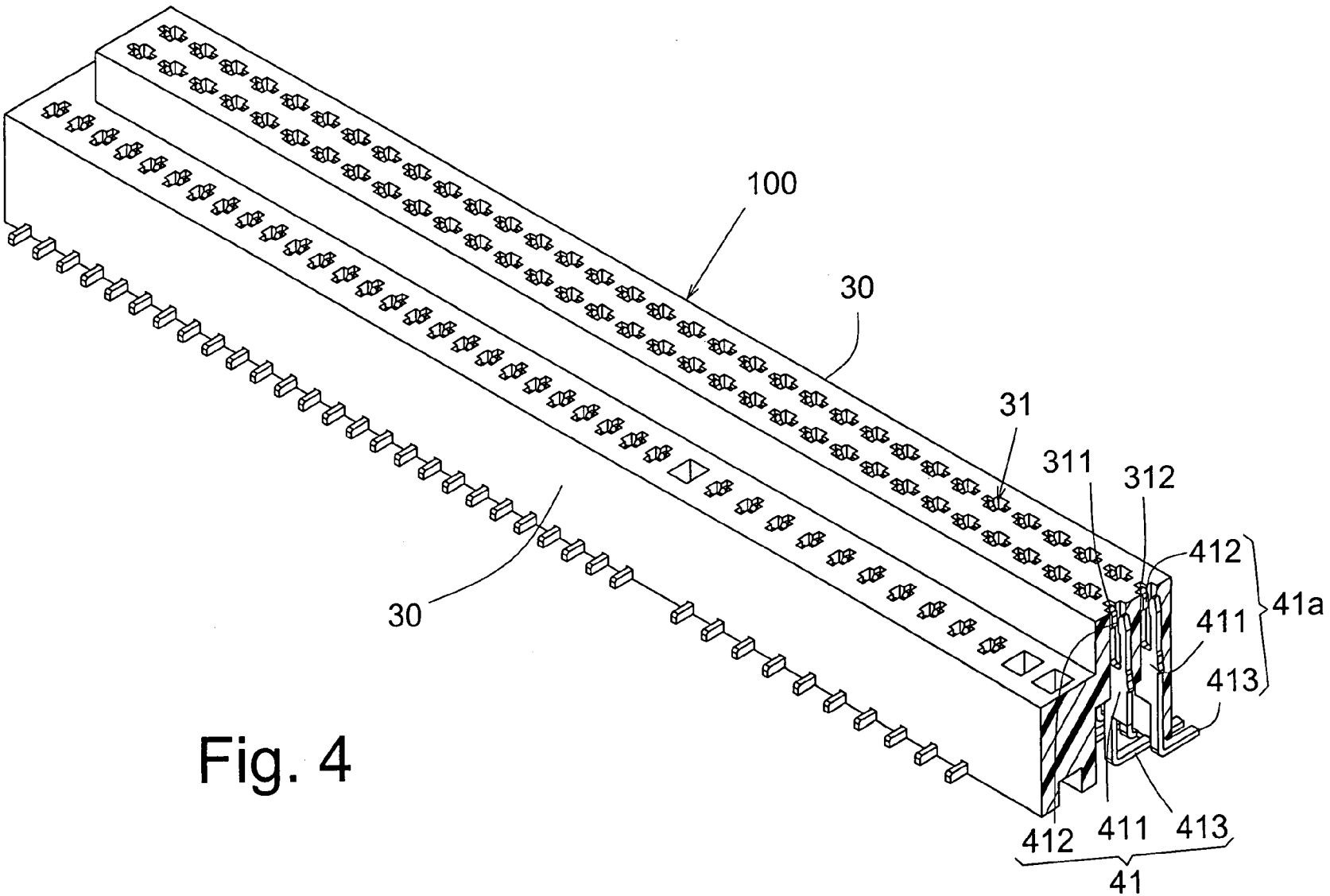
FIG. 4 is a partially sectional view taken along line 4—4 of FIG. 3.

Referring to FIGS. 1, 4 and 7, each first type of terminal 41, 41*a* has a base section 411 correspondingly inlaid in the terminal mounting orifices 311, 312 of the first type of terminal mounting orifice section 31. A top end of the base section 411 is downward recessed to form a chucking notch 412 for tightly chucking the inserted terminal 53, 54 of the first type of electronic card connector 50. A soldering section 413 downward extends from bottom end of the base section 411 to be soldered on the circuit board 80 of a card-reader.

Figure 8:
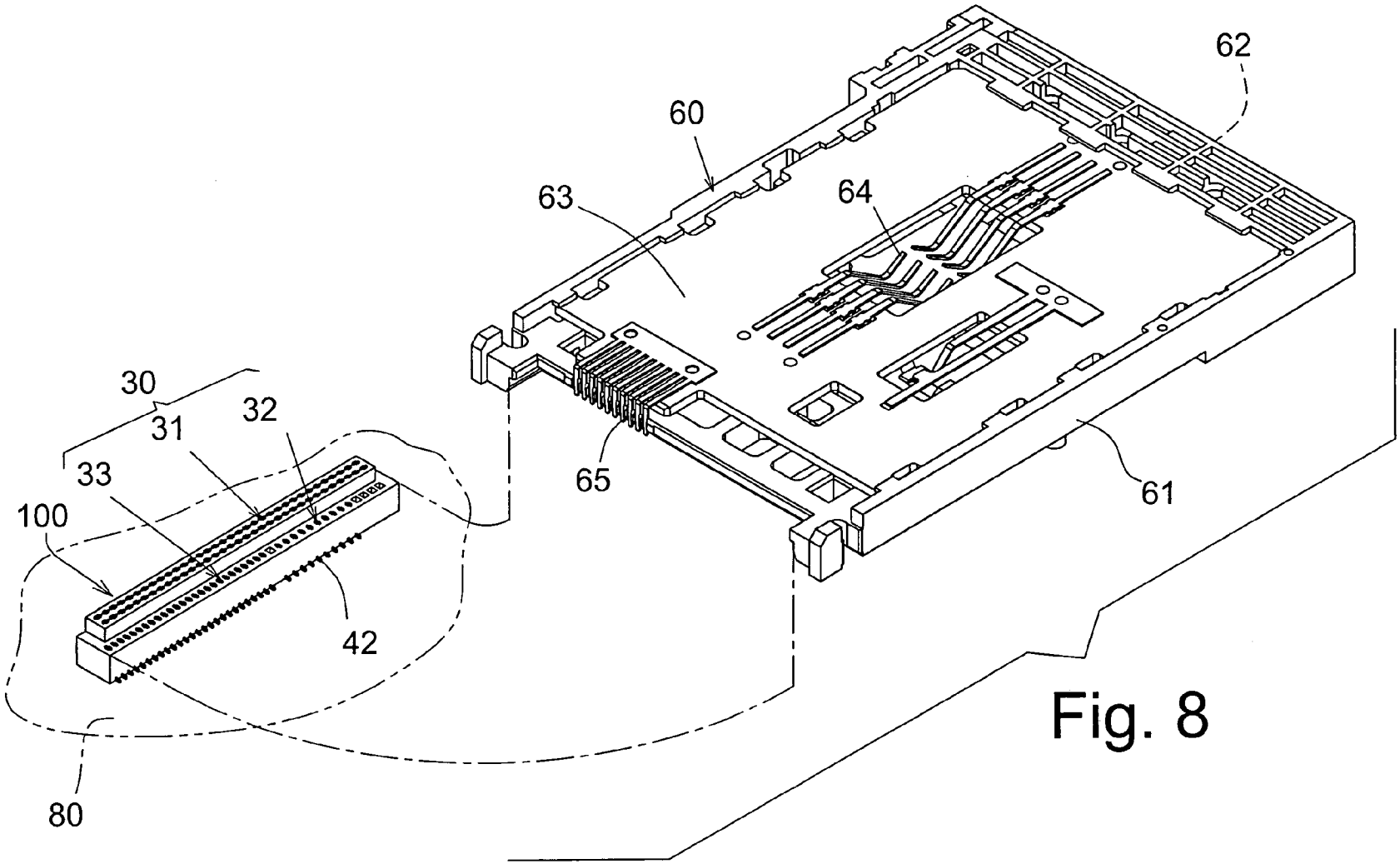
FIG. 8 is a perspective view showing that the second type of electronic card connector is inserted in the present invention.

Referring to FIG. 8, the second type of electronic card connector 60 is an electronic card connector for smart card. The electronic card connector 60 includes a main body 61 formed with a slide slot 62 in which a smart card can be inserted. A circuit board 63 is fixedly connected with the main body 61. Multiple resilient terminals 64 are disposed on the circuit board 63. The resilient terminals 64 extend into the slide slot 62 to correspondingly contacting with the contacts (not shown) of the chip of the inserted smart card. The circuit board 63 is connected with multiple terminals 65 which protrude from the main body 61 to be correspondingly inserted into the second type of terminal mounting orifice section 32 of the socket 100. The terminals 65 are electrically connected with the second type of terminals 42. The second type of electronic card connector 60 in not the subject of the present invention. The three-in-one socket 100 of the electronic card connector of the present invention is adapted to all the conventional electronic card connectors. The application range of the present invention is not limited to the second type of electronic card connector 60.

Figure 5:
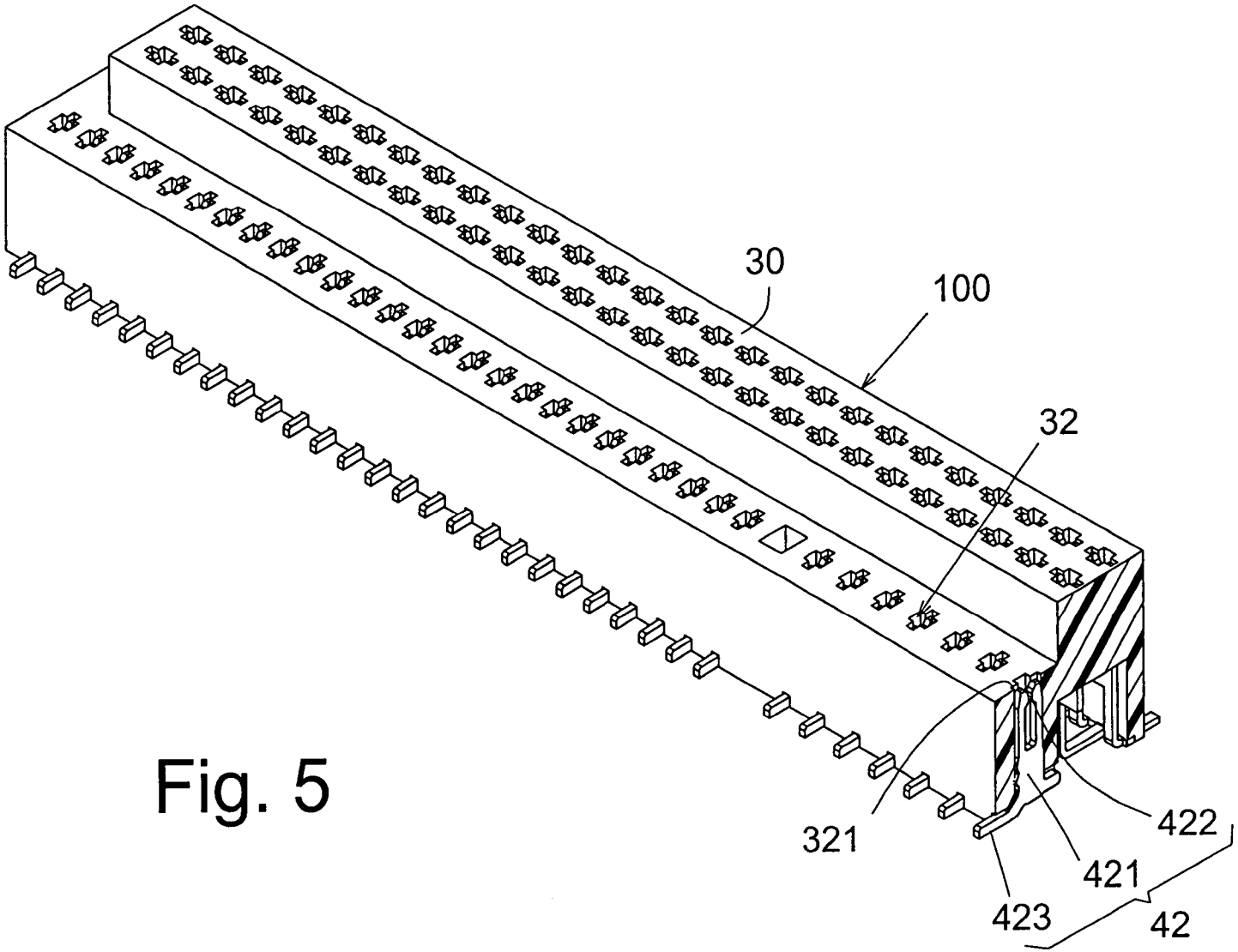
FIG. 5 is a partially sectional view taken along line 5—5 of FIG. 3.
Figure 6:
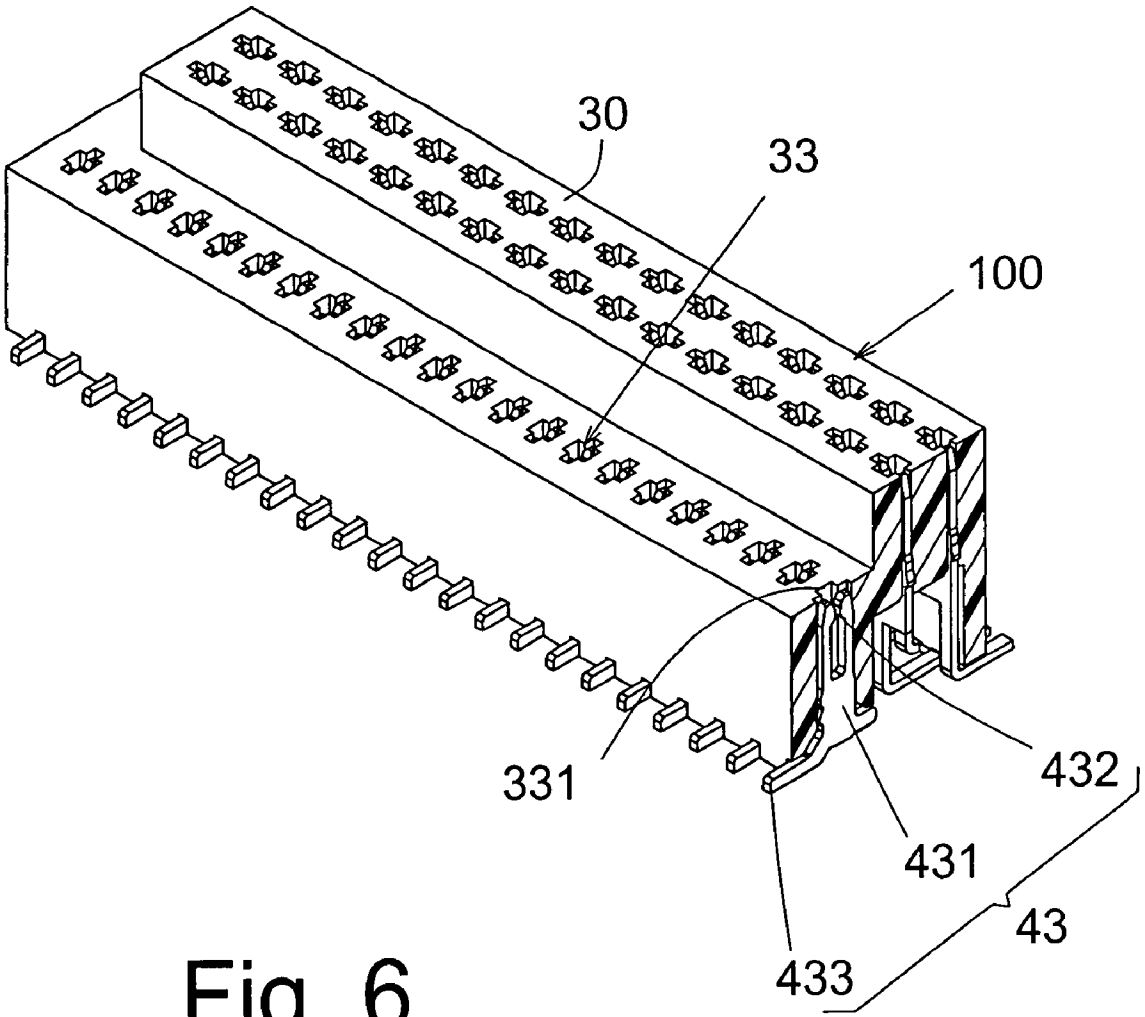
FIG. 6 is a partially sectional view taken along line 6—6 of FIG. 3.

Referring to FIGS. 1, 5 and 8, each second type of terminal 42 has a base section 421 correspondingly inlaid in the terminal mounting orifices 321 of the second type of terminal mounting orifice section 32 of the plastic main body 30. A top end of the base section 421 is downward recessed to form a chucking notch 422 for tightly chucking the inserted terminal 65 of the second type of electronic card connector 60. A soldering section 423 downward extends from bottom end of the base section 421 to be soldered on the circuit board 80 of the card-reader.

Referring to FIGS. 1, 6, 9 and 10, the third type of electronic card connector 70 is an electronic card connector for an express card. The electronic card connector 70 includes a main body 71 formed with a slide slot 72 in which an express card can be inserted. Multiple terminals 73 are inlaid in bottom end of the slide slot 72. The terminals 73 protrude from the main body 71 to be correspondingly inserted into the third type of terminal mounting orifice section 33 of the socket 100. The terminals 73 contact with the third type of terminals 43. The third type of electronic card connector 70 in not the subject of the present invention. The three-in-one socket 100 of the electronic card connector of the present invention is applicable to all the conventional electronic card connectors. The application range of the present invention is not limited to the third type of electronic card connector 70.

Each third type of terminal 43 has a base section 431 correspondingly inlaid in the terminal mounting orifices 331 of the third type of terminal mounting orifice section 33 of the plastic main body 30. A top end of the base section 431 is downward recessed to form a chucking notch 432 for tightly chucking the inserted terminal 73 of the third type of electronic card connector 70. A soldering section 433 downward extends from bottom end of the base section 431 to be soldered on the circuit board 80 of the card-reader.

Figure 9:
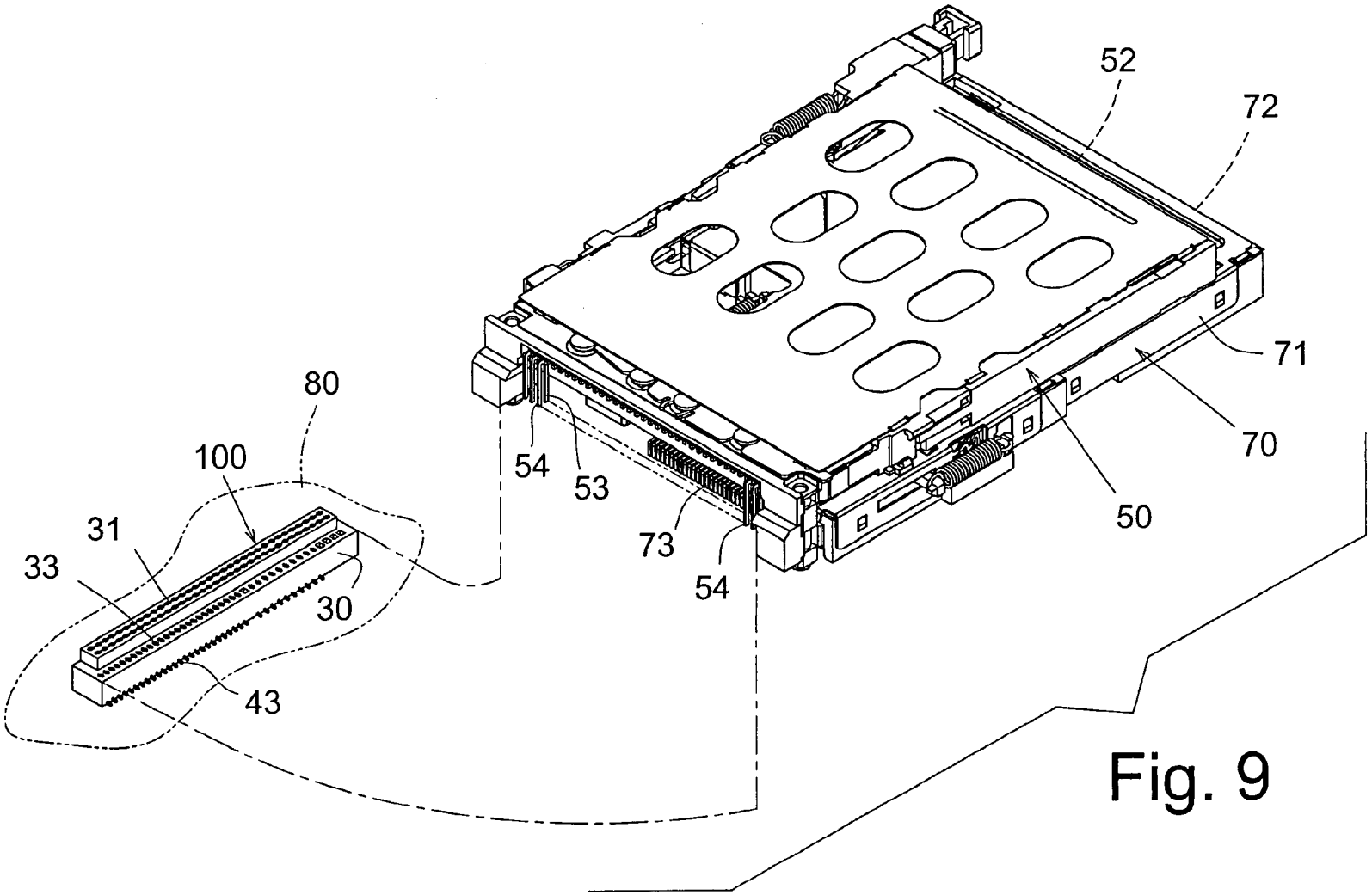
FIG. 9 is a perspective view showing that a stacked electronic card connector composed of the first and third types of electronic card connector is inserted in the present invention.
Figure 10:
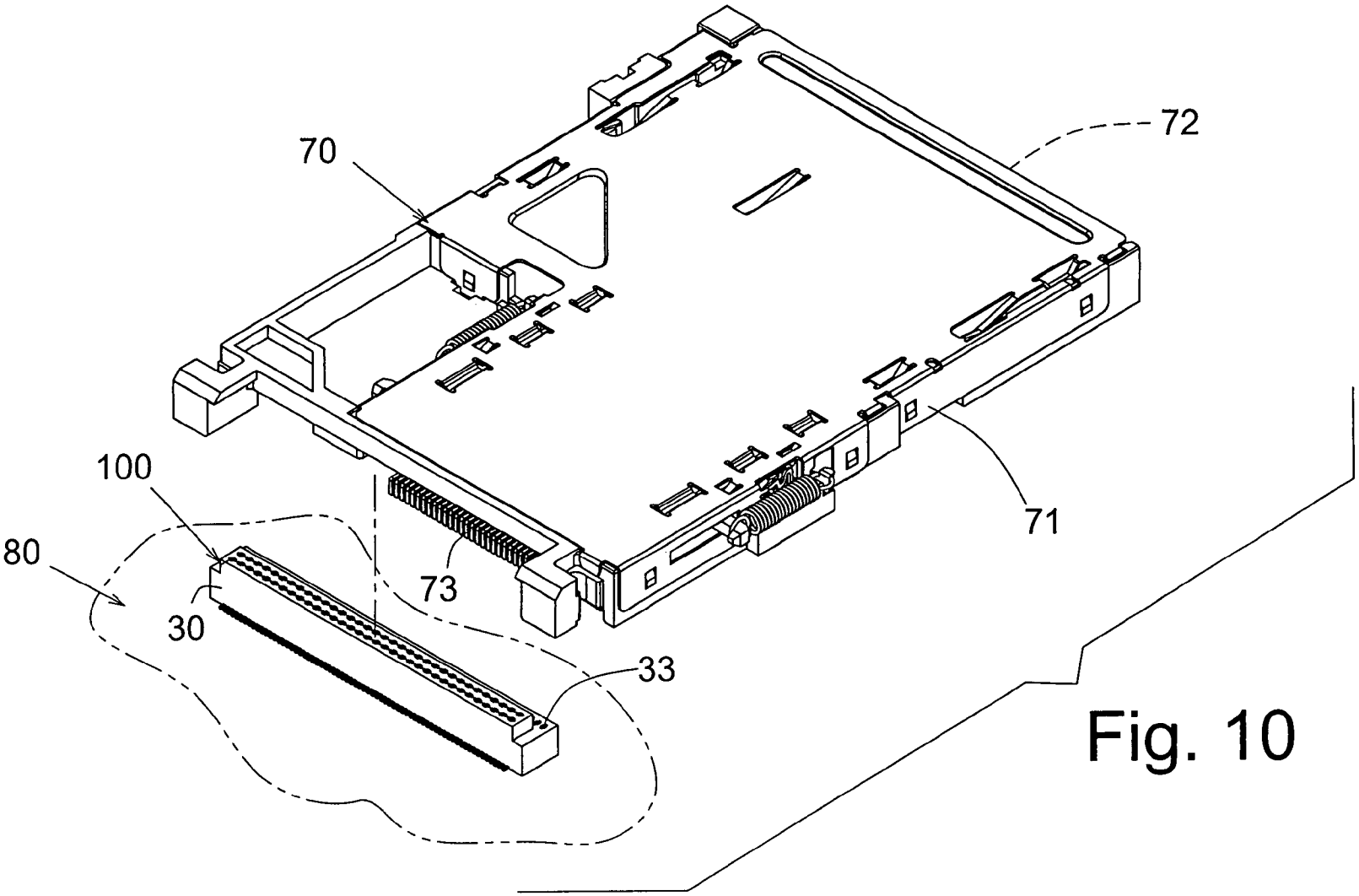
FIG. 10 is a perspective view showing that the third type of electronic card connector is inserted in the present invention.

Referring to FIGS. 7 and 9, two different types of electronic card connectors (such as a stacked electronic card connector composed of the first and second types of electronic card connectors or the first and third types of electronic card connectors) can be at the same time inserted in the three-in-one socket 100 of the electronic card connector of the present invention. Alternatively, referring to FIGS. 8 and 10, only one single electronic card connector (such as the second or third type of electronic card connector) is inserted in the three-in-one socket 100. The pattern of the stacked electronic card connector is not limited. For example, a stacked electronic card connector composed of the second and third types of electronic card connectors 60, 70 can be inserted in the three-in-one socket 100 of the present invention.

The three-in-one socket 100 of the present invention is characterized in that the plastic main body 30 is formed with a first, a second and a third types of terminal mounting orifice sections 31, 32, 33. The terminal mounting orifice sections 31, 32, 33 are formed with different types and numbers of terminal mounting orifices in which different types and numbers of terminals are inlaid. After the three-in-one socket 100 is soldered on a circuit board 80, the circuit board 80 is connectable with three different types of electronic card connectors. Therefore, in manufacturing, the manufacturers only need to manufacture one specification of circuit board. By means of the three-in-one socket 100, any of the three types of electronic card connectors or any stacked electronic card connector composed of any two types of electronic card connectors can be adapted to the circuit board 80. Therefore, the application range of the circuit board 80 is widened.

FIGS. 11 to 18 show a modified three-in-one socket 100' of the present invention, in which the first type of terminal mounting orifice section 31 of the plastic main body 30' includes two staged rows of terminal mounting orifices 311, 312. A guide notch 311*a*, 312*a* is formed on upper front edge of each terminal mounting orifice 311, 312 for guiding the terminal 53, 54 of another kind of first type of electronic card connector 50' into the terminal mounting orifice 311, 312. The terminal 53, 54 contacts with the first type of terminal 41, 41*a* inlaid in the terminal mounting orifice 311, 312.

Figure 11:
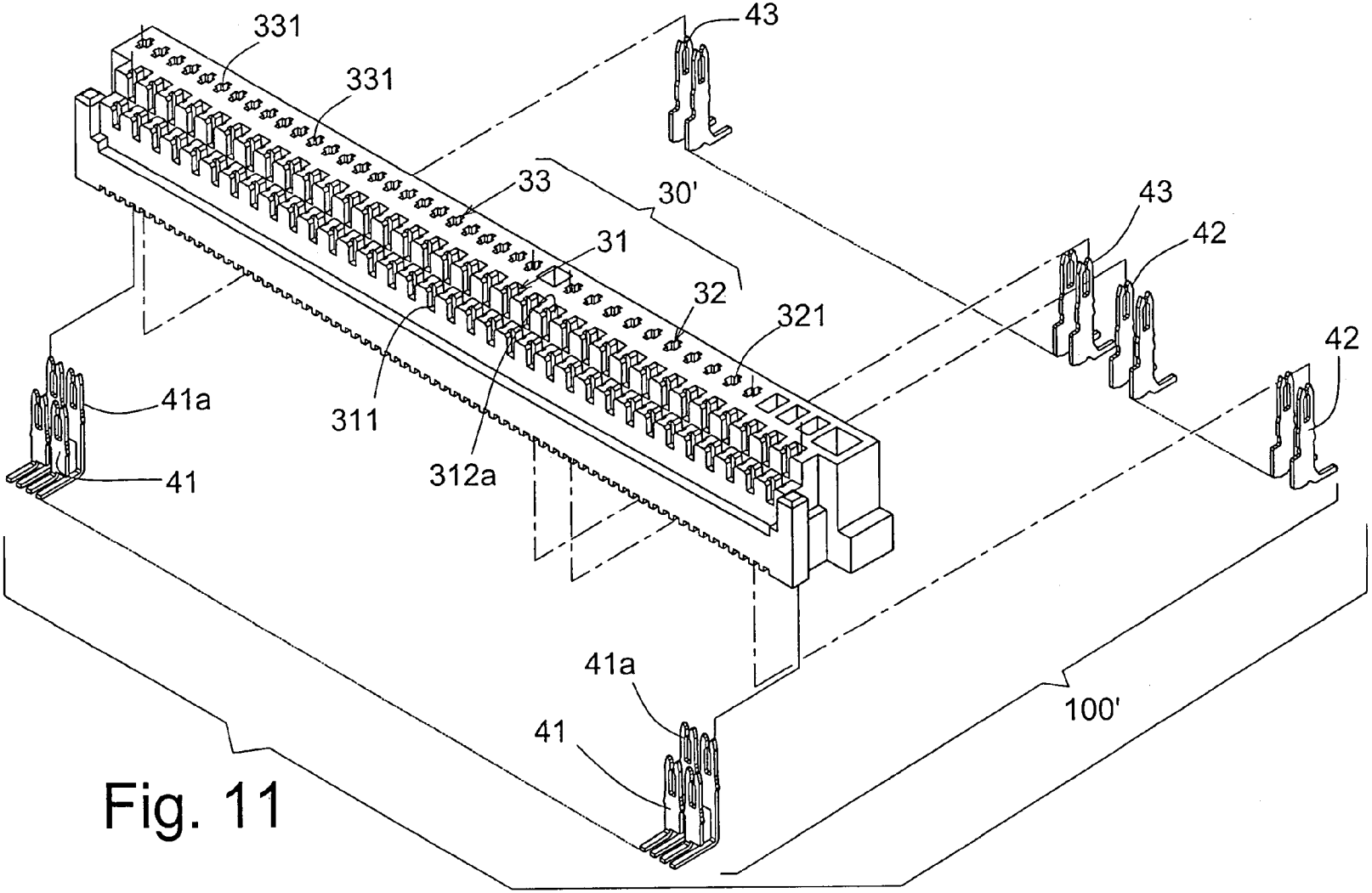
FIG. 11 is a perspective exploded view of another embodiment of the present invention.
Figure 12:
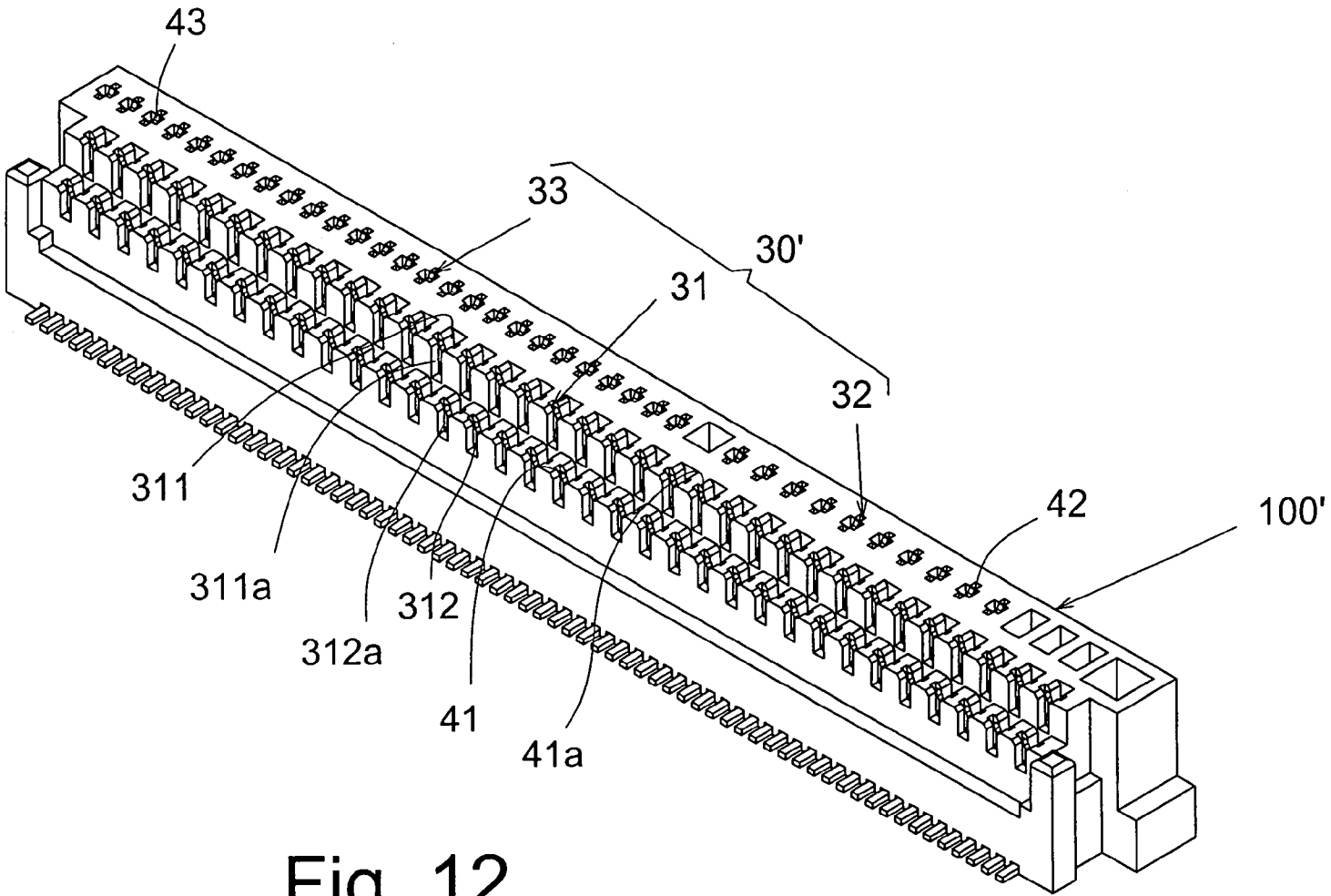
FIG. 12 is a perspective assembled view of the embodiment of FIG. 11.
Figure 13:
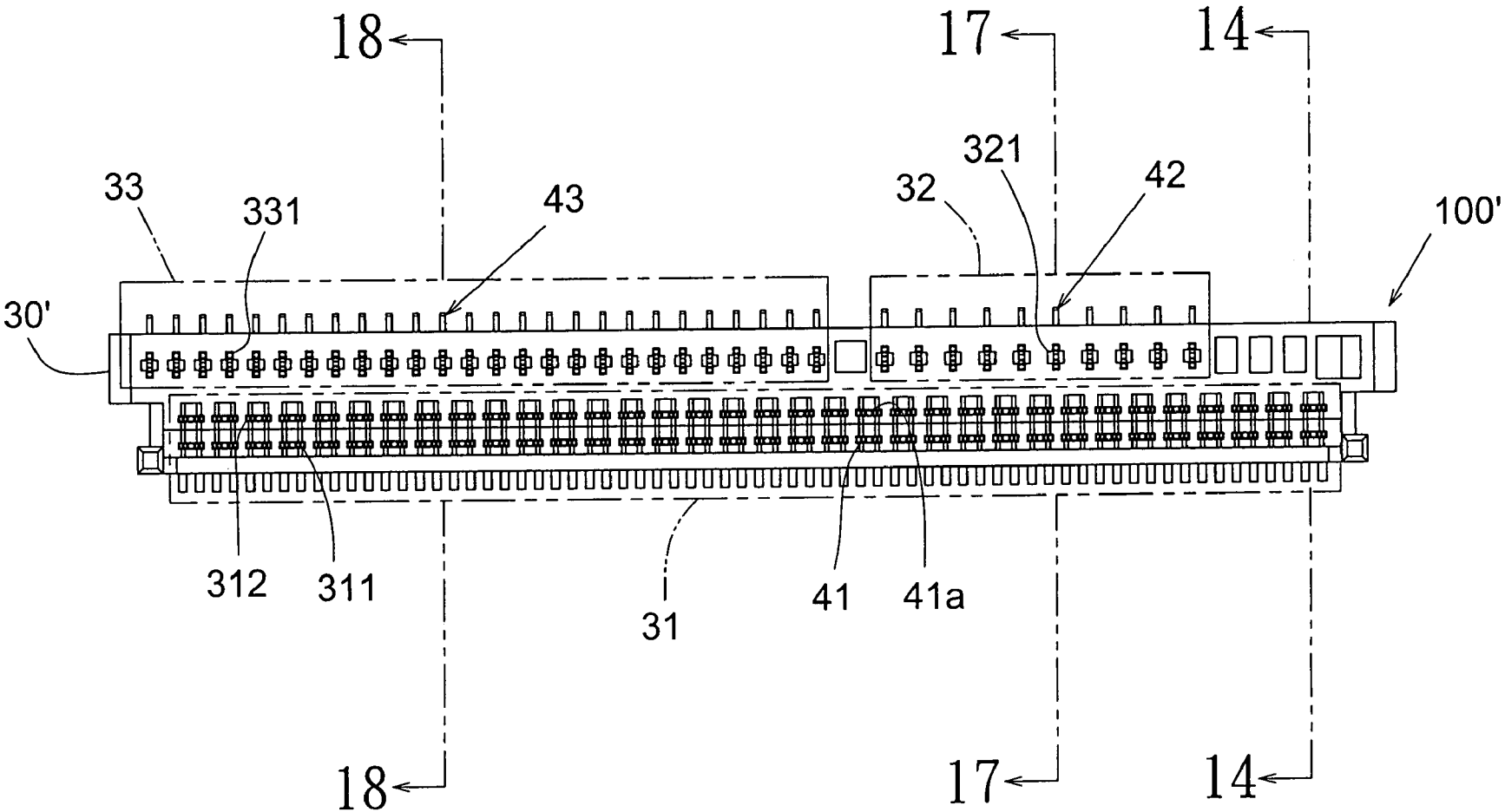
FIG. 13 is a top view according to FIG. 12.
Figure 14:
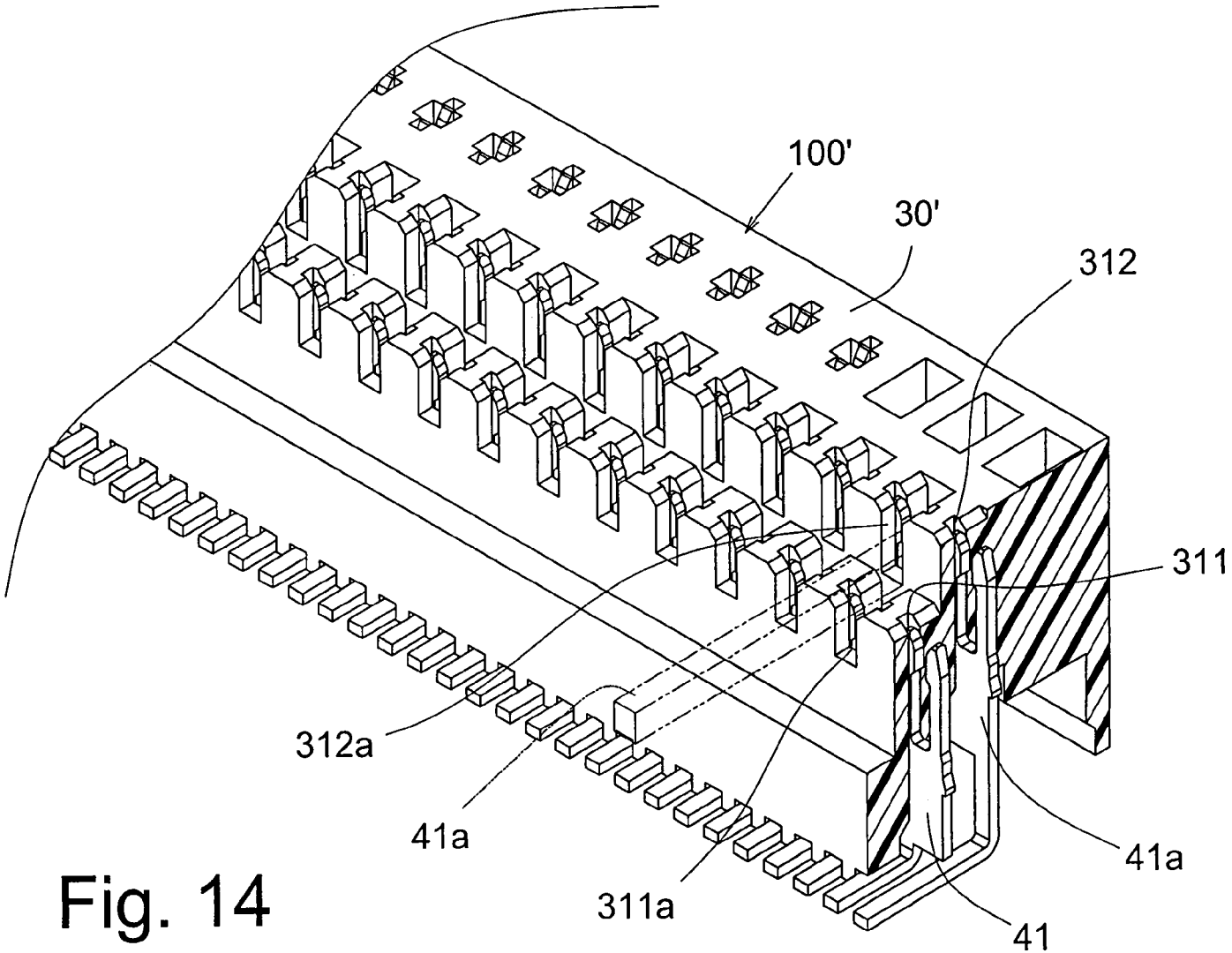
FIG. 14 is a partially sectional view taken along line 14—14 of FIG. 13, showing the contact section of the first type of terminal.
Figure 15:
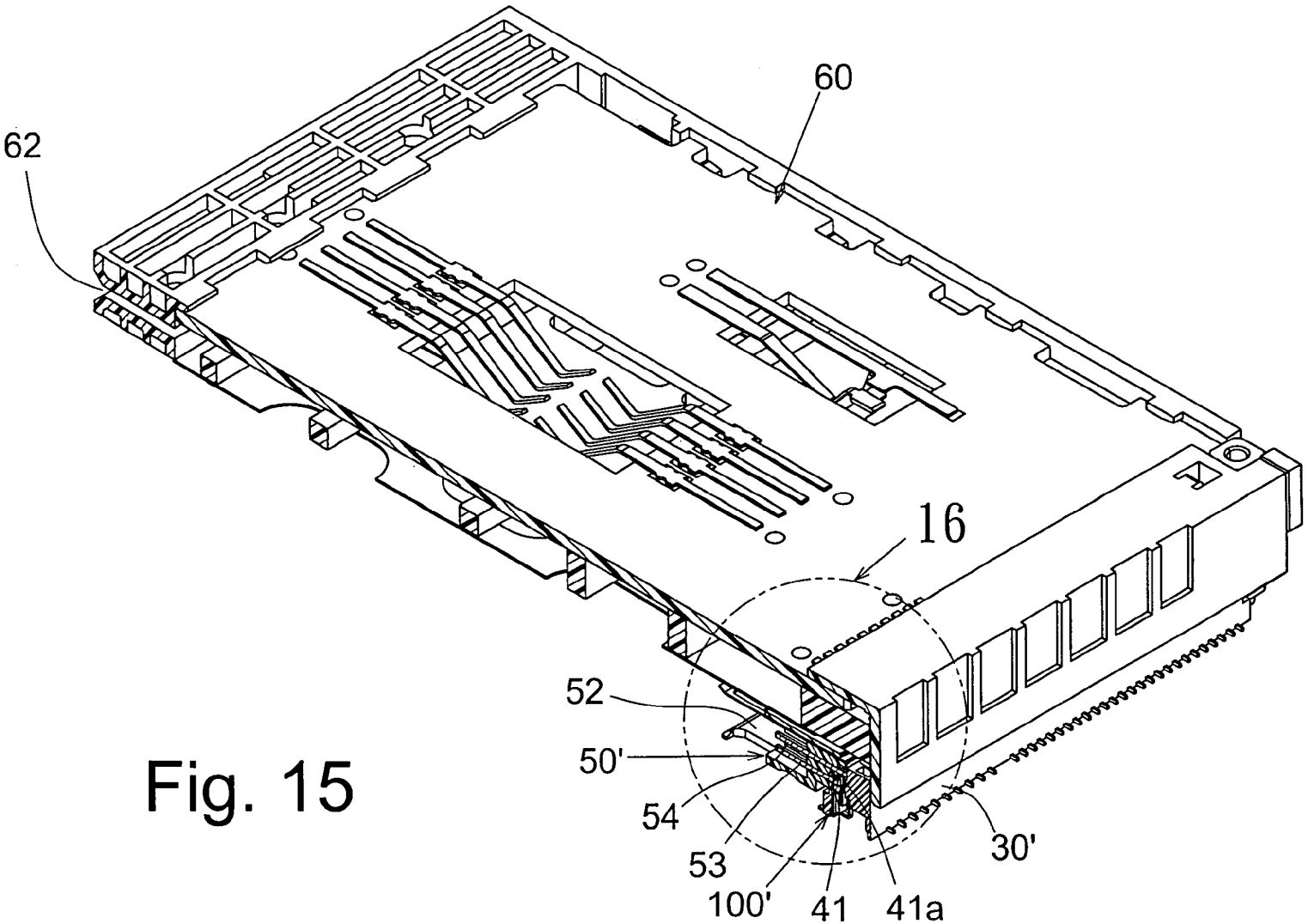
FIG. 15 is a perspective sectional view of the embodiment of FIG. 11, showing the mounting of another kind of first and second types of electronic card connectors on the socket of the present invention.
Figure 16:
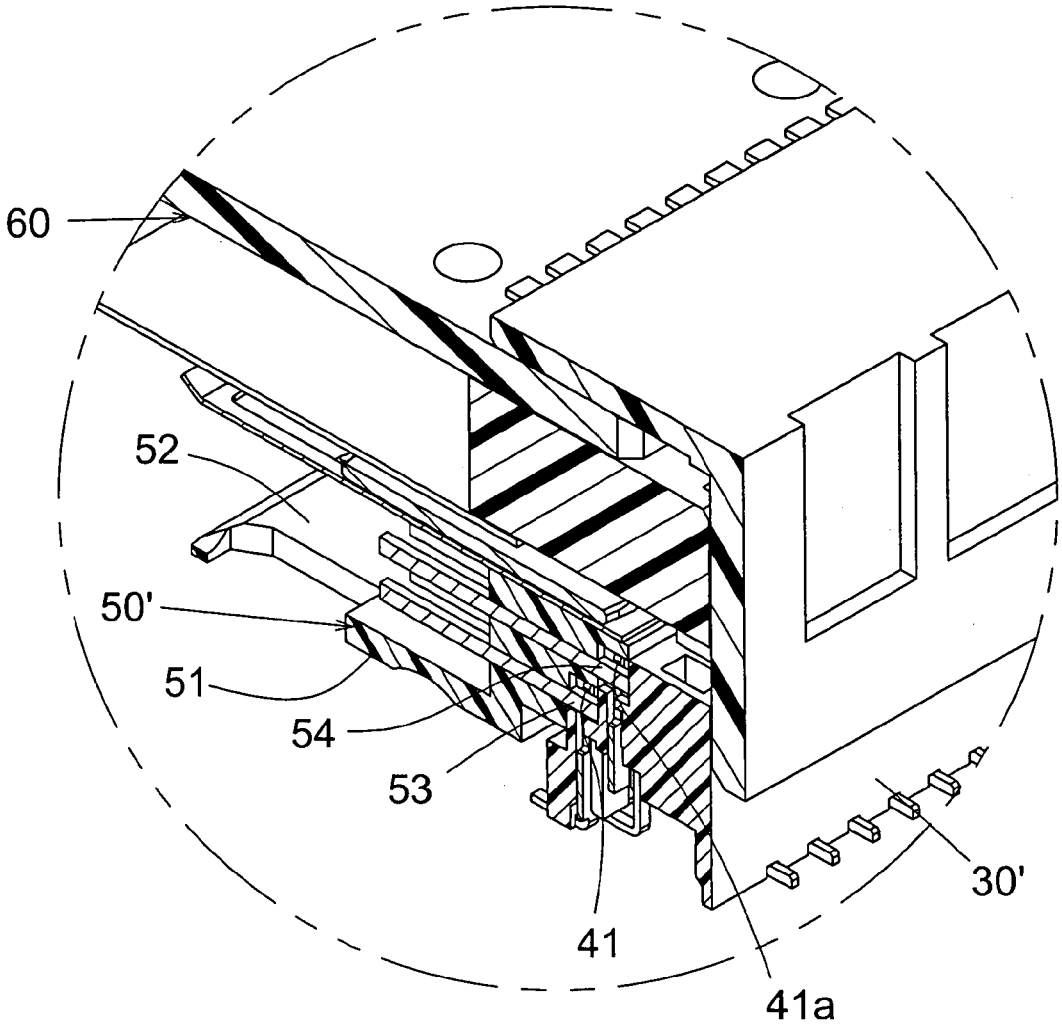
FIG. 16 is an enlarged view of circled area 16 of FIG. 15.
Figure 17:
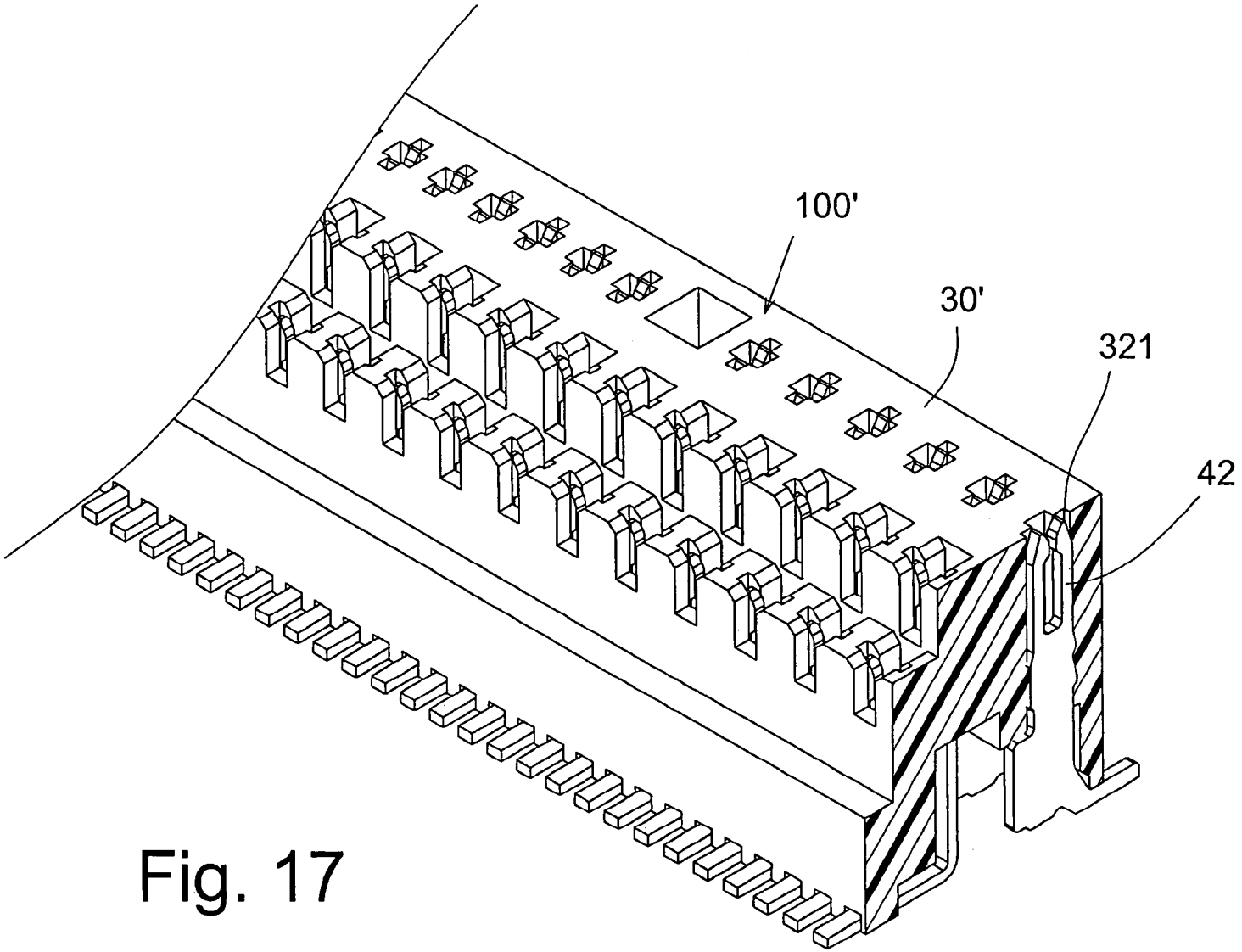
FIG. 17 is a partially sectional view taken along line 17—17 of FIG. 13, showing the contact section of the second type of terminal.
Figure 18:
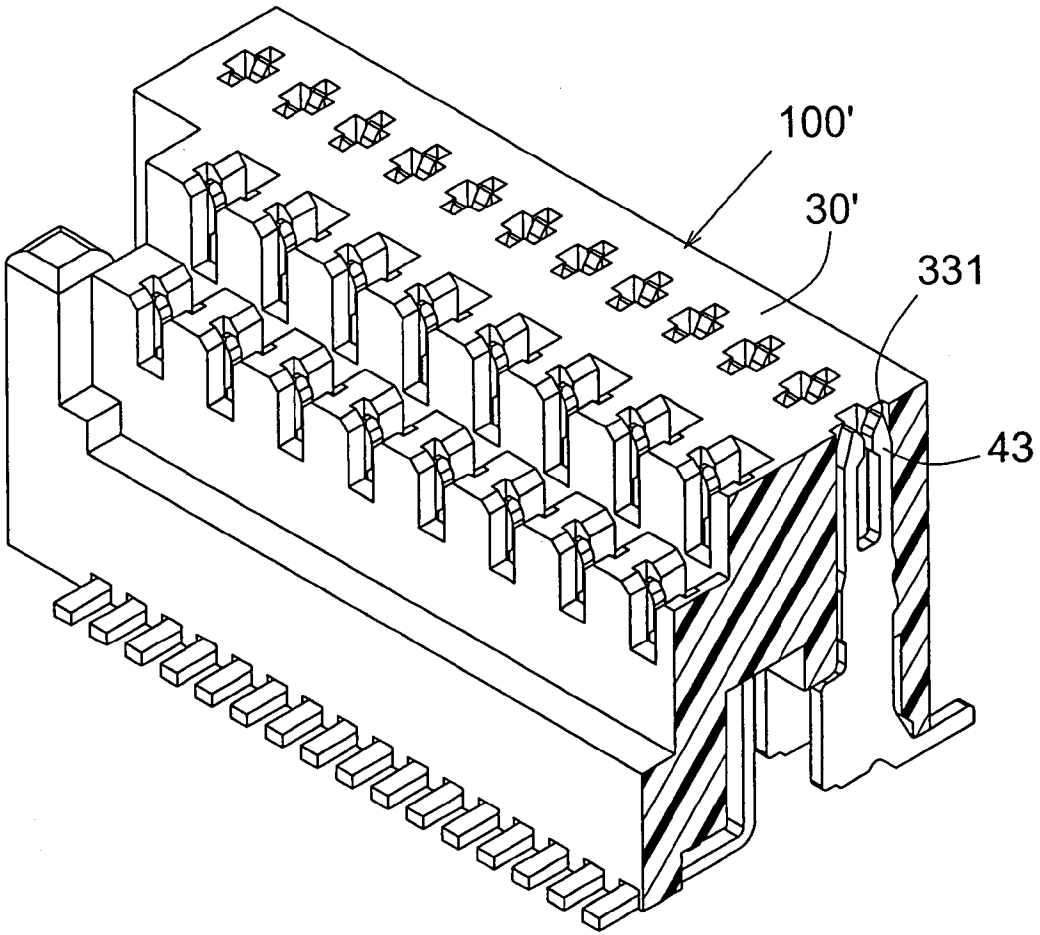
FIG. 18 is a partially sectional view taken along line 18—18 of FIG. 13, showing the contact section of the third type of terminal.

Referring to FIGS. 1 and 11, the position relationship between the first, second and third types of terminal mounting orifice sections 31, 32, 33 of the three-in-one socket 100 or 100' arranged on the plastic main body 30 or 30' is not limited.

The above embodiments are only used to illustrate the present invention, not intended to limit the scope thereof.

Many modifications of the above embodiments can be made without departing from the spirit of the present invention.

What is claimed is:

1. A three-in-one socket of an electronic card connector, comprising a plastic main body, the plastic main body being formed with a first type of terminal mounting orifice section, a second type of terminal mounting orifice section and a third type of terminal mounting orifice section, the first type of terminal mounting orifice section being formed with two rows of terminal mounting orifices in each of which a first type of terminal is inlaid for correspondingly connecting with a terminal of a first type of electronic card connector, the second type of terminal mounting orifice section being formed with a row of terminal mounting orifices in each of which a second type of terminal is inlaid for correspondingly connecting with a terminal of a second type of electronic card connector, the third type of terminal mounting orifice section being formed with a row of terminal mounting orifices in each of which a third type of terminal is inlaid for correspondingly connecting with a terminal of a third type of electronic card connector.

2. The three-in-one socket of the electronic card connector as claimed in claim 1, wherein the first type of terminal mounting orifice section of the plastic main body includes two rows of terminal mounting orifices which are staged, a guide notch being formed on upper front edge of each terminal mounting orifice.

3. The three-in-one socket of the electronic card connector as claimed in claim 1, wherein each first type of terminal has a base section correspondingly inlaid in the terminal mounting orifice of the first type of terminal mounting orifice section, a top end of the base section being downward recessed to form a chucking notch for tightly chucking the inserted terminal of the first type of electronic card connector, a soldering section downward extending from bottom end of the base section of the first type of terminal to be soldered on a circuit board of a card-reader.

4. The three-in-one socket of the electronic card connector as claimed in claim 1, wherein each second type of terminal has a base section correspondingly inlaid in the terminal mounting orifice of the second type of terminal mounting orifice section, a top end of the base section being downward recessed to form a chucking notch for tightly chucking the inserted terminal of the second type of electronic card connector, a soldering section downward extending from bottom end of the base section of the second type of terminal to be soldered on a circuit board of a card-reader.

5. The three-in-one socket of the electronic card connector as claimed in claim 1, wherein each third type of terminal has a base section correspondingly inlaid in the terminal mounting orifice of the third type of terminal mounting orifice section, a top end of the base section being downward recessed to form a chucking notch for tightly chucking the inserted terminal of the third type of electronic card connector, a soldering section downward extending from bottom end of the base section of the third type of terminal to be soldered on a circuit board of a card-reader.

* * * * *